US005255413A

United States Patent [19]

Sabo

[11] Patent Number: 5,255,413

[45] Date of Patent: Oct. 26, 1993

[54] FURNITURE KNOB AND PROCESS FOR ATTACHING TO FURNITURE

[75] Inventor: Irving Sabo, Easton, Conn.

[73] Assignee: Ethan Allen Inc., Danbury, Conn.

[21] Appl. No.: 896,192

[22] Filed: Jun. 10, 1992

[51] Int. Cl.[5] ..... E05B 1/00

[52] U.S. Cl. ..... 16/121; 16/118; 16/DIG. 30

[58] Field of Search ..... 16/118, 121, DIG. 30

[56] References Cited

U.S. PATENT DOCUMENTS

| | | | |
|---|---|---|---|
| 6,473 | 5/1849 | Laird | 16/121 |
| 745,404 | 12/1903 | Tower | 16/121 |
| 760,298 | 5/1904 | Bassick | 16/121 |
| 1,639,159 | 8/1927 | Anderson | 16/121 |
| 1,735,604 | 11/1929 | Delany | 16/118 |
| 2,080,656 | 5/1937 | DeVries | 16/121 |
| 2,796,627 | 6/1957 | Heyer | 16/121 |
| 3,024,555 | 3/1962 | Abeles | 16/118 |

*Primary Examiner*—W. Donald Bray
*Attorney, Agent, or Firm*—Schweitzer Cornman & Gross

[57] ABSTRACT

The invention concerns a furniture knob suitably having a rectangular or oval front peripheral contour, the knob comprising a knob portion having a front face and a back face, part of the back face being adapted to be gripped by the fingers of a hand, and a shank portion at the back face of the knob portion, the shank portion having a square cross section and a longitudinal axis that is perpendicular to the back face. The invention also concerns a process for attaching the knob to a furniture face.

18 Claims, 2 Drawing Sheets

FURNITURE KNOB AND PROCESS FOR ATTACHING TO FURNITURE

FIELD OF THE INVENTION

The present invention relates to a furniture knob and a process for attaching it to furniture so that it is prevented from rotation.

BACKGROUND OF THE INVENTION

A large variety of knobs are used on the outer faces of furniture for decorative, utilitarian, or both decorative and utilitarian purposes. These knobs usually have a protruding knob portion usually adapted to be grabbed by the fingers of a hand, and a shank portion with its longitudinal axis disposed perpendicularly to the back of the knob portion. The shank usually ranges into or through the furniture face and to be attached to it from the opposite side, such as by either a bolt or a nut being screwed into or onto the shank portion. Knobs of this type have a tendency of working loose after a while and, in addition to the discomfort of using a loose knob, the knob can also turn around the shank portion within the hole in the furniture face. This tendency of furniture knobs to become loose in the furniture face and freely rotate therein, has largely prevented the use of other than completely round furniture knobs. This has considerably limited the decorative effects that could be achieved with furniture knobs.

DESCRIPTION OF THE PRESENT INVENTION

It is the object of the present invention to provide a furniture knob and the process for attaching it to a furniture face, wherein the peripheral contour of the knob can have any desired shape, even other than round, and which maintains the knob in a desirably aligned position without it being able to rotate and thus come out of alignment.

The present invention achieves this objective by providing a furniture knob for attachment to a furniture face, the knob having a knob portion which is adapted to be grabbed by the fingers of a hand and having a front face and a back face, the knob also having a shank portion which is disposed perpendicularly to the knob portion. At least a part of the shank portion which is adjacent to the knob portion has a square cross section such as a tenon adapted to be fitted into a complimentary square cross section recess, such as a mortise within the furniture face. In one embodiment of the furniture knob of the present invention, the square cross section shank portion continues in a round cross section shank portion which is optionally threaded for attachment of means, such as a nut, for blocking the shank portion in the hole of the furniture face against movement of the shank in the axial direction.

As used throughout the specification and the claims, "furniture face" refers to any wall portion of any furniture which has a face side facing outwardly and an opposite side facing inwardly. The furniture face can be part of a movable portion of the furniture, such as the front of a drawer or a door in which case the knob serves the purpose of pulling the drawer or the door open. The furniture face can also be a stationary part of the furniture in which case the knob usually serves more likely a decorative purpose rather than a utilitarian purpose such as for pulling. In a suitable embodiment, the furniture knob of the present invention includes a shank portion with a square cross section, which is an elongated member integrally attached to the rear of the knob portion perpendicularly thereto, and is suitably one piece with the knob portion. As used throughout the specification and the claims, the term "square" is used only for purposes of convenience, because that term is usually associated with square mortises in woodworking, but as used herein the term also includes rectangular and other polygonal shapes, as well as oval and the like cross sections, as long as it is not round.

Carriage bolts are used in wood working in locations where a nut is to be attached to a bolt where the head of the bolt cannot be accessed and held against rotation during tightening of the nut. For that purpose the inaccessible head of the carriage bolt is a flat, slightly domed bolt head that cannot be grabbed and held by any tool, and the top part of the shank of the carriage bolt has a short, square cross section portion which fits into a complimentarily shaped square mortise in the wood. In this manner a screw can be wound onto the threaded portion of the carriage bolt and the nesting of the square cross section portion of the shank of the bolt in the square mortise holds the bolt against rotation.

The present invention utilizes to some extent a similar principle to prevent rotation of the furniture knob. The attractive furniture knob of the present invention which can be round but suitably a square or the like oval shape, can be maintained in perfect alignment, especially if other knobs on the furniture have to be maintained in similar relative alignment to each other. They can be affixed to the furniture face in accordance with the present invention and maintained permanently in such alignment.

DESCRIPTION OF THE DRAWING

The invention is further disclosed with reference being had to the drawing, wherein.

DETAILED DESCRIPTION OF THE INVENTION

Figure 1:
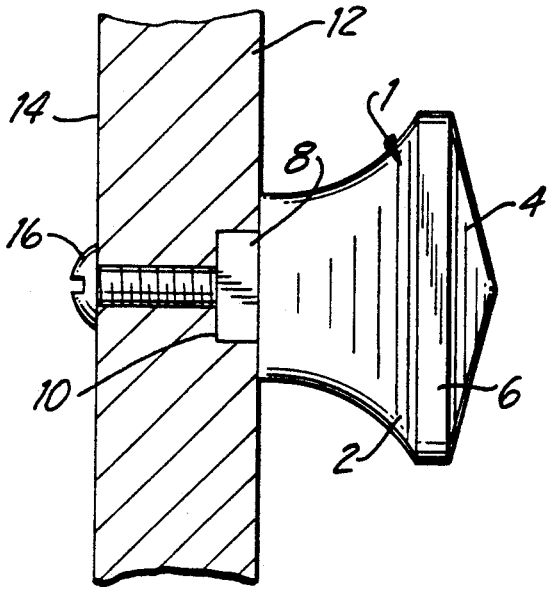
FIG. 1 is a cross sectional view of a furniture knob having a square shank cross section.
Figure 2:
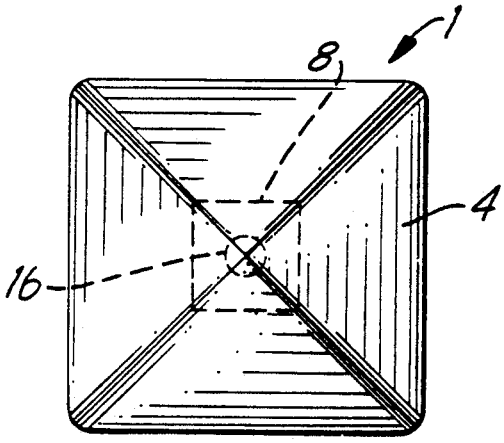
FIG. 2 is a top view of the knob of FIG. 1.

In FIGS. 1 and 2, a knob 1 is shown having a knob portion 2. The knob portion has a front face 4 and a rear face 6. A square cross section shank 8 is suitably formed integrally and of one piece with the knob portion 2.

The shank 8 is suitably formed as a tenon which is nested within a complimentarily square cross section mortise 10 in the furniture face 12. In the opposite side 14 a screw 16 penetrates through the furniture face into the rearward facing end of the knob 1 and is screwed thereinto for attachment to the furniture face. Alternatively, the tenon shank 8 can be glued into the mortise 10. If desired, however, both such gluing and the use of a screw 16 can be employed for the strongest form of attachment.

Figure 3:
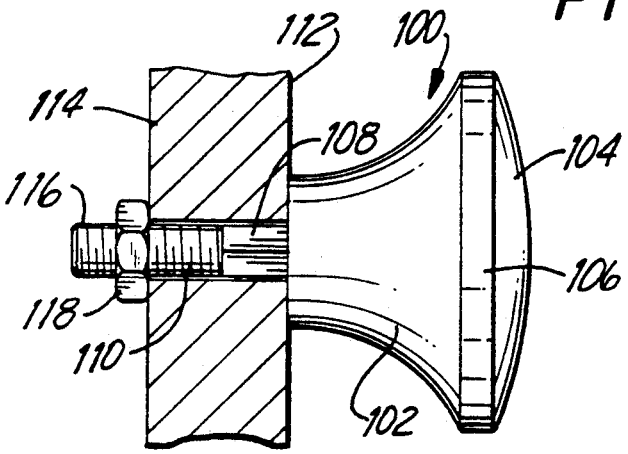
FIG. 3 is a cross sectional view of another embodiment showing a furniture knob with a threaded shank attached to the knob.

In FIG. 3 a knob 100 is shown, comprised of a knob portion 102 having a front face 104 and a rear face 106. A shank 108 having a square cross section adjacent to the knob portion 102, is perpendicularly affixed to the rear face 106 of the knob portion. Beyond the square cross section portion, the shank 108 has a round cross section shank portion 116 which is optionally threaded. The shank is disposed in a bore 110 of the furniture face 112 and is attached on the opposite side 104 by a nut or axial locking means 118 to prevent movement of the knob in the furniture face in an axial direction.

Figure 4:
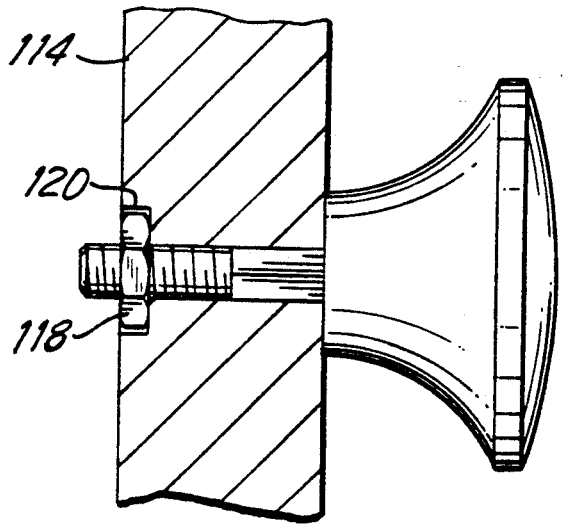
FIG. 4 is a cross sectional view of another variant of FIG. 3 with a recessed knob.

Essentially the same type of knob is shown in FIG. 4. However, here, the nut or axial locking means is recessed within the opposite side 114 on the furniture face within a recess 120.

Figure 5:
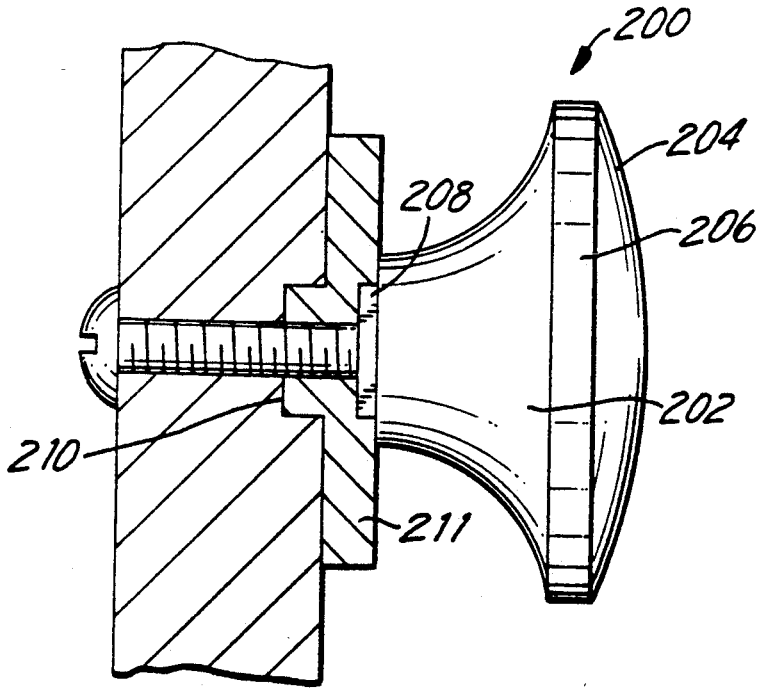
FIG. 5 is a cross sectional view of a knob with an intermediate piece.

In FIG. 5, a further decorative effect is achieved with a knob 200 in accordance with the present invention. The knob has a front face 204, and a rear face 206. The knob is similar to that shown in FIG. 1, in that the knob in FIG. 2 also has a shank 208 which has a square cross section. This square cross section is disposed within a square recess for the disposition of the complimentarily shaped square shank therein of an intermediate decorative piece 211.

A square bore or mortise 210 is provided in the furniture face for the disposition therein of a complimentarily shaped shank portion or tenon of the intermediate piece. Both the intermediate piece and the knob portion are attached to the furniture face in the same manner as shown in FIG. 1.

It is to be understood that the decorative intermediate piece and construction in accordance with the present invention can be employed with any other furniture knob and attachment method in accordance with the present invention.

Square recesses, such as mortises can be suitably made by that are known per se. For example, a mortise can be made with a mortise chisel which has an auger to make a round hole in the furniture face, and an e.g., rectangular chisel to cut corners into the round hole.

I claim:

1. A furniture knob having a front peripheral contour, the knob comprising a knob portion having a front face and a back face, part of the back face being adapted to be gripped by the fingers of a hand, and a shaped cross section shank portion at the back face for attachment to furniture having a complementarily shaped cavity therein, the shank portion having a longitudinal axis that is perpendicular to the back face, said longitudinal axis being adapted to include means for attaching said shank portion through the furniture.

2. The furniture knob of claim 1, wherein said shaped cross section is a square cross section, and said square cross section extends over the entire length of said longitudinal axis.

3. The furniture knob of claim 2, wherein said shank portion is integral and of one piece with, and of the same material as the knob portion.

4. The furniture knob of claim 1, wherein the shank portion is a stem having a rectangular cross section and being firmly attached to said back face.

5. The furniture knob of claim 4, wherein the part of said stem adjacent to the back face has a square cross section, and wherein the part of said stem remote from said back face has a round cross section and is optionally threaded.

6. The furniture knob of claims 1, 2, 3, or 4, wherein said front peripheral contour is other than a circle.

7. The furniture knob of claim 6, wherein said front peripheral contour is square or oval.

8. A process for attaching a knob to a furniture face having a face side and an opposite side to the face side, comprising inserting the furniture knob of claim 1 into a square cross section recess in said furniture face, said square recess being complimentarily shaped to said square cross section shank portion, and attaching the furniture knob to said furniture face.

9. The process of claim 8, wherein said step of attaching the furniture knob comprises attaching the knob from said opposite side.

10. The process of claim 8, wherein the square cross-section shank portion is integral and of one piece with, and of the material of the knob portion, and said step of attaching comprises adhesively attaching the shank portion into said recess.

11. The process of claim 8, wherein the square cross section shank portion is integral and of one piece with, and of the material of the knob portion, and said step of attaching comprises driving a screw into said shank portion from said opposite side.

12. The process of claim 11, wherein said step of attaching further comprises adhesively attaching the shank portion of the knob into said recess.

13. The process of claim 8, wherein said step of attaching comprises locking the shank from said opposite side for substantially preventing movement of said furniture knob in a direction away from the furniture face.

14. The process of claim 13, wherein the shank portion is a stem firmly attached to said back face, and the part of said stem adjacent to the back face has a square cross section, and the part of said stem remote from said back face has a round cross section and is optionally threaded, and said step of locking comprises attaching a locking means onto said optionally threaded shank portion from said opposite side.

15. The process of claim 14, wherein said step of attaching comprises screwing a nut onto the threaded portion.

16. The process of claim 8, further comprising disposing between said furniture face and said knob portion an intermediate member having a recess therein for said shank portion.

17. The process of claim 16, wherein the recess in said intermediate member is a square cross section recess that is complimentary to the square cross section of said shank portion.

18. The process of claim 17, wherein said intermediate member has a front facing the knob portion and a back facing the furniture face, and a concentric square cross section shank portion being complimentary with the square cross section of the recess in said furniture face.

* * * * *